US007862443B2

(12) United States Patent
Cameron

(10) Patent No.: US 7,862,443 B2
(45) **Date of Patent: *Jan. 4, 2011**

(54) GOLF CLUB

(75) Inventor: Don T. Cameron, Calsbad, CA (US)

(73) Assignee: Acushnet Company, Fairhaven, MA (US)

( * ) Notice: Subject to any disclaimer, the term of this patent is extended or adjusted under 35 U.S.C. 154(b) by 676 days.

This patent is subject to a terminal disclaimer.

(21) Appl. No.: 11/503,125

(22) Filed: Aug. 14, 2006

(65) Prior Publication Data

US 2006/0276259 A1 Dec. 7, 2006

Related U.S. Application Data

(63) Continuation-in-part of application No. 10/946,394, filed on Sep. 22, 2004.

(51) Int. Cl.
*A63B 69/36* (2006.01)
*A63B 53/02* (2006.01)
*A63B 53/06* (2006.01)

(52) U.S. Cl. ..... 473/244; 473/245; 473/246; 473/248; 473/251; 473/305; 473/313; 473/314

(58) Field of Classification Search ..... 473/324–350, 473/244–255, 305–315; D21/736–746
See application file for complete search history.

(56) References Cited

U.S. PATENT DOCUMENTS 3,191,936 A * 6/1965 Guier ..... 473/313
3,341,203 A * 9/1967 Brill ..... 473/298
3,909,005 A * 9/1975 Piszel ..... 473/248
3,980,301 A * 9/1976 Smith ..... 473/314
4,231,576 A 11/1980 Perkins ..... 473/242
4,852,879 A 8/1989 Collins ..... 473/251
4,909,515 A 3/1990 Redkey ..... 473/236
5,137,275 A 8/1992 Nelson ..... 473/306
5,292,128 A * 3/1994 Solheim ..... 473/313
5,308,068 A * 5/1994 Strand ..... 473/251
5,492,329 A 2/1996 Kronlon ..... 473/220
5,564,990 A * 10/1996 Weeks ..... 473/251

(Continued)

FOREIGN PATENT DOCUMENTS

JP 8-224324 9/1996

*Primary Examiner*—Sebastiano Passaniti
(74) *Attorney, Agent, or Firm*—Hanify & King, P.C.

(57) ABSTRACT

A golf putter with a novel offset and shaft-attachment design is disclosed and claimed. The club includes a head having a strike surface, a sole, and a top line. A tube is coupled to the head, a coupling member is coupled to the distal end of the tube, and a shaft is also coupled to the coupling member. The coupling member connects the tube and the shaft such that they are relatively offset. The longitudinal axes of the tube and the shaft may be substantially parallel, or the coupling member may be adjustable such that the longitudinal axes are not parallel. An alignment indicia is provided on the club head. The tube is coupled to the head at an angle such that it blocks the indicia from a user's view at address when the head is aligned properly. If the club head is not properly aligned, the golfer will be able to see the indicia and therefore know to adjust the club head before putting. Thus, putter disclosed and claimed herein provides both offset and a putting alignment aide.

16 Claims, 3 Drawing Sheets

U.S. PATENT DOCUMENTS

| | | | | | |
|---|---|---|---|---|---|
| 5,616,087 | A | | 4/1997 | Bothwell | 473/316 |
| 5,626,528 | A | * | 5/1997 | Toulon | 473/248 |
| 5,803,824 | A | | 9/1998 | Rollingson | 473/246 |
| 5,839,973 | A | * | 11/1998 | Jackson | 473/305 |
| D404,450 | S | | 1/1999 | Weeks | D21/743 |
| 6,095,929 | A | | 8/2000 | Clark | 473/248 |
| D434,094 | S | | 11/2000 | Miyashita | D21/744 |
| 6,213,889 | B1 | * | 4/2001 | Hamburger | 473/245 |
| 6,234,915 | B1 | * | 5/2001 | Wu | 473/248 |
| 6,287,215 | B1 | | 9/2001 | Fisher | 473/309 |
| 6,471,599 | B2 | | 10/2002 | Ford | 473/242 |
| 6,663,496 | B2 | | 12/2003 | Cameron et al. | 473/220 |
| 2003/0207724 | A1 | | 11/2003 | Cameron et al. | |
| 2004/0102254 | A1 | | 5/2004 | Mills | 473/244 |

* cited by examiner

GOLF CLUB

CROSS-REFERENCE TO RELATED APPLICATIONS

This is a continuation-in-part of U.S. patent application Ser. No. 10/946,394 filed on Sep. 22, 2004, now pending, which is incorporated herein by reference in its entirety.

BACKGROUND OF THE INVENTION

1. Field of the Invention

The present invention relates to a golf club, and, more particularly, the present invention relates to a golf putter with a novel offset and shaft-attachment design.

2. Description of the Related Art

Golf club heads come in many different forms and makes, such as wood- or metal-type, iron-type (including wedge-type club heads), utility- or specialty-type, and putter-type. Each of these styles has a prescribed function and make-up. The present invention primarily relates to putters, which typically are used to strike a golf ball and impart to it a rolling travel path.

There are many styles of putters, including blades, mallets, heel-toe weighted, and T-line putters. Different types of putters provide different advantages. For example, some putters provide offset such that the shaft is forward of the hosel. This helps the golfer achieve a desired putting posture of having the hands forward of the club head. Known offset golf putters initially extend substantially vertically away from the club head (such as via a hosel), and then transition into an offset shaft that is angled heel-ward relative the club head. Other putters provide an alignment means to help the golfer achieve a proper putting alignment. Since these alignment means can be distracting to the golfer and can tend to shift the golfer's focus away from the golf ball, it would be beneficial to block the alignment means from the golfer's view when a proper putting alignment is achieved. However, there are no known putters that provide such an alignment means while also providing an offset shaft.

SUMMARY OF THE INVENTION

The present invention relates to a golf putter with a novel offset and shaft-attachment design. The club includes a head having a strike surface, a sole, and a top line. A tube is coupled to the head, preferably along the top line, and extends away from the head. A coupling member is coupled to the distal end of the tube. A shaft is also coupled to the coupling member. The coupling member connects the tube and the shaft such that they are relatively offset. A preferred amount of offset is from about 0.1 inch to 1 inch. The tube is coupled to the head at an angle from about 2° to 45°, and preferably the shaft is coupled such that its longitudinal axis is parallel to the tube longitudinal axis. The tube preferably has a length between about 1 inch and 4 inches, and the travel distance from a junction between the shaft and the coupling member to the sole preferably is 5 inches or less. The coupling member may be provided with female projections into which the tube and the shaft are coupled. Alternatively, the coupling member may be provided with male connections over which the tube and the shaft are coupled. The coupling member may include two portions joined together by an adjustable connection to allow for customization of the resulting golf club.

The tube may be coupled to the club head at any desirable location. A preferred location is along the top line. If the tube is coupled to the top line, it preferably is coupled within a middle third or a heel-end third of the top line length. The tube has a relatively low specific gravity compared to the club head to provide a desirable moment of inertia. Preferably, the tube is a lower section of a shaft.

As an instrument for helping the golfer properly align the club during use, the club head has an alignment indicia thereon. The indicia may be provided in any form, with a plurality of dots being preferred. In a preferred embodiment, the indicia is provided on the heel side of the head, adjacent the tube. Since the tube is coupled to the head at an angle, the tube blocks the indicia from a user's view at address when the head is aligned properly. If the club head is not properly aligned at address, the golfer will be able to see the alignment indicia and, therefore, know to adjust the club to square it with the intended putting path.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
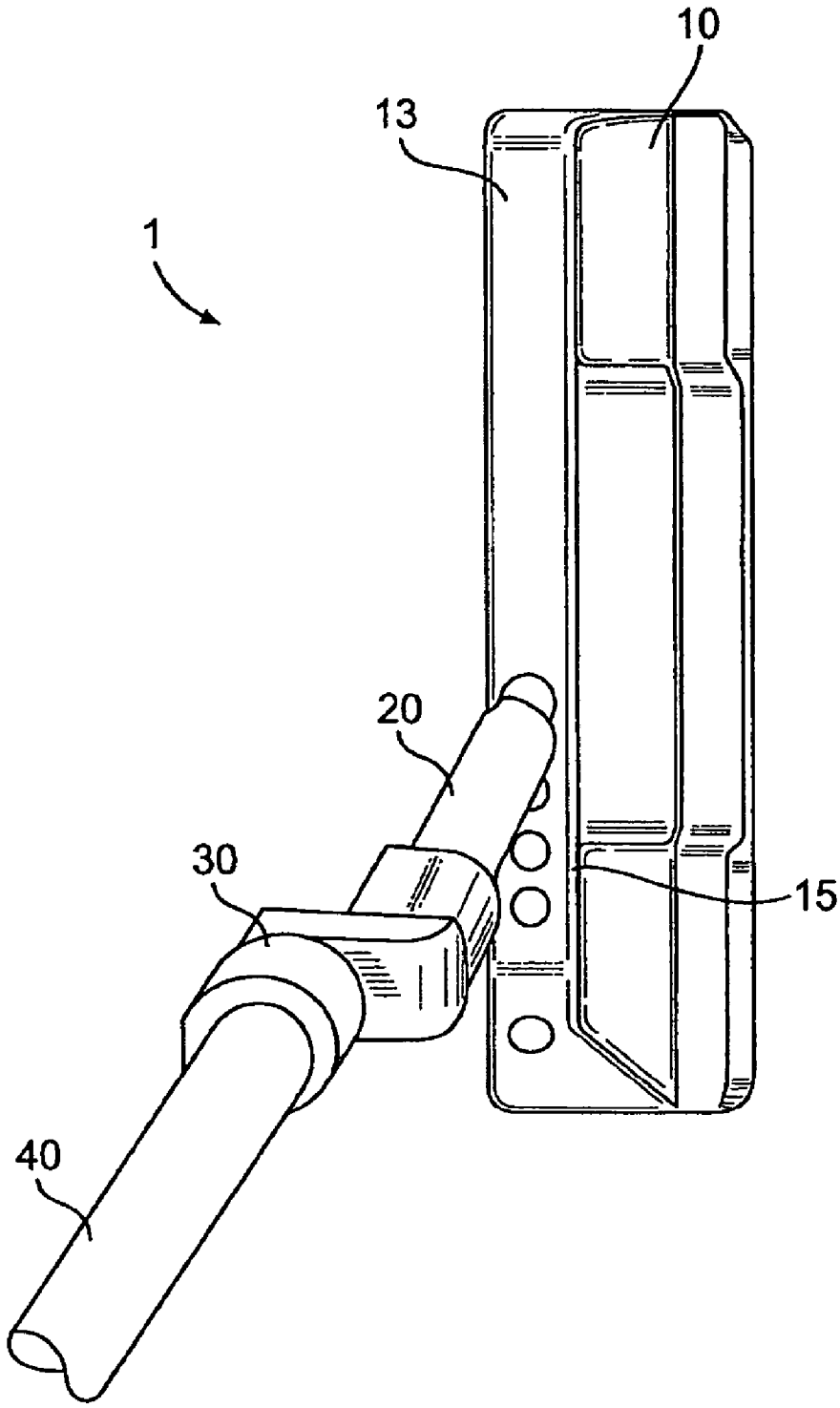
FIG. 1 shows a top view of a golf club of the present invention.
Figure 2:
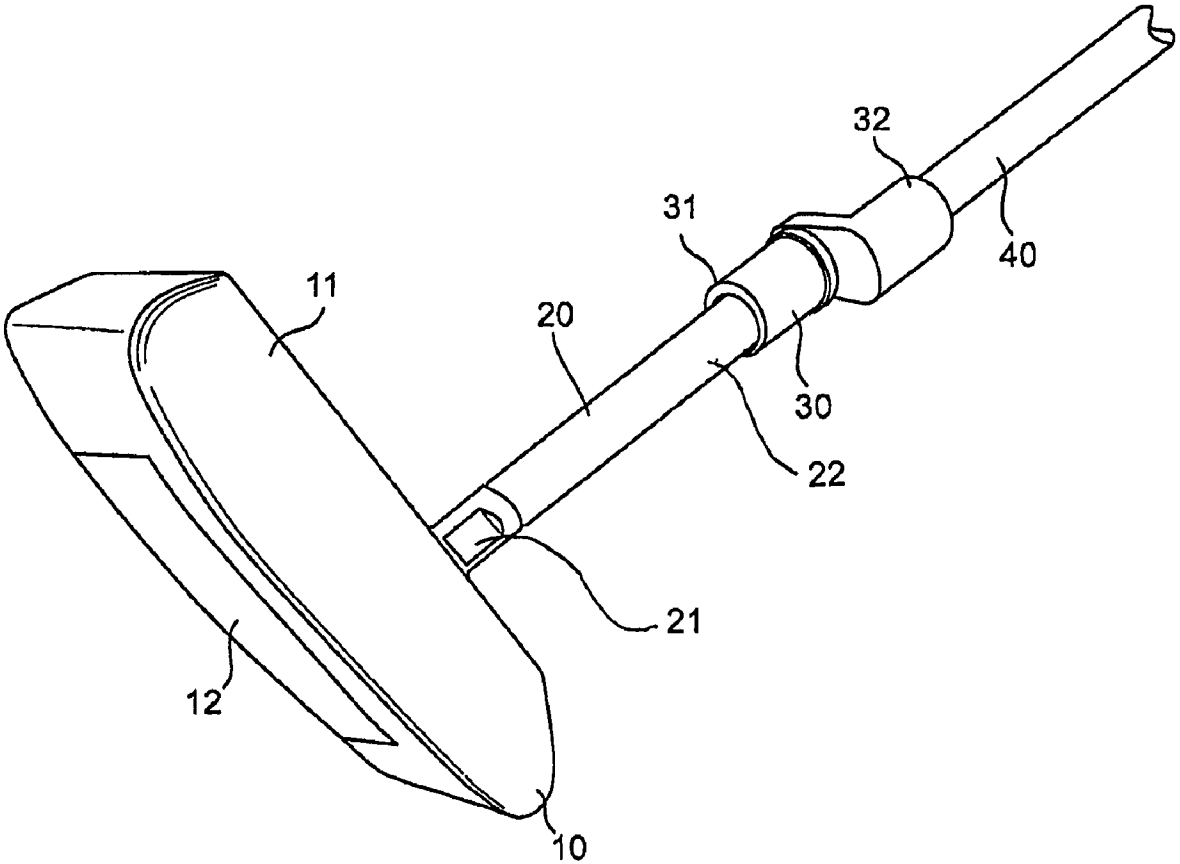
FIG. 2 shows a front view of the golf club of FIG. 1.

FIG. 1 shows a top view of a golf club 1 of the present invention, and FIG. 2 shows a front view of the golf club 1. The golf club 1 includes a head 10 having a strike face 11, a sole 12, and a top line 13. A tube 20 is coupled to the head 10, either directly thereto or via a hosel. This hosel may be male, such that it is not seen in the assembled product. A first end 21 of the tube 20 is coupled to the head 10, with the tube 20 extending away from the head 10. A first end 31 of a coupling member 30 is coupled to the tube 20 at a tube second end 22. A shaft 40 is coupled to a second end 32 of the coupling member 30. (Only a portion of the shaft 40 is shown in the figures.) These parts are assembled in known fashion, such as by welding and/or through the use of an adhesive.

Inertia is a property of matter by which a body remains at rest or in uniform motion unless acted upon by some external force. Moment of inertia (MOI) is a measure of the resistance of a body to angular acceleration about a given axis, and is equal to the sum of the products of each element of mass in the body and the square of the element's distance from the axis. Thus, as the distance from the axis increases, the MOI increases. As the MOI increases, the stability and playability of the club head increases. The club head 10 preferably is contoured and weighted to produce desirable MOI and acoustic characteristics during use.

The tube 20 has a specific gravity less than that of the head 10, preferably substantially less. In a preferred embodiment, the tube 20 is a lower portion of a shaft, such as the shaft 40. Use of a lightweight tube 20 beneficially removes, to a large degree, the influence the hosels of typical golf clubs have on those clubs' MOI. The result is a more balanced and playable golf club. This is particularly important with golf putting shots, for which the acceptable margin of error is particularly small. The tube 20 preferably has a mass of 3 to 5 grams. The size of the coupling member 30 is controlled to further enhance the club head MOI, and preferably the coupling member 30 has a mass of 5 to 15 grams.

During a proper putting stroke, the golfer's hands are slightly ahead of the putter head. For this reason, putter designers commonly incorporate some amount of offset in their clubs. That is, the shaft is positioned forward (i.e., towards the strike face) from the hosel or club head. In the club 1 of the present invention, the coupling member 30 preferably provides offset between the shaft 40 and the tube 20 and/or the head 10. A preferred amount of offset is from 0.1 inch to 1 inch. In a preferred embodiment, an extension of the longitudinal axis of the shaft 40 intersects the strike face 11.

It is important that a golfer strike the ball squarely. This is particularly important with putting shots, due to the small margin of error associated with these shots. As an instrument for helping the golfer properly align the club 1, the club head 10 includes an alignment indicia 15 thereon. The indicia 15 may be provided in a variety of forms, a plurality of dots being preferred. The indicia 15 may be an integral part of the head 10, or it may be affixed thereto. In a preferred embodiment, the indicia 15 is provided on the heel side of the head 10, adjacent the tube 20. The tube 20 is coupled to the head 10 at an angle, such that the tube 20 blocks the indicia from a user's view at address when the head 10 is aligned properly. Blocking an alignment indicia from the golfer's view while putting is beneficial because it eliminates a source of distraction to the golfer. In such a "mental" sport as golf, eliminating distractions can provide great benefits to the golfer. A golfer's eye will naturally be drawn to a club head alignment means, so the indicia 15 of the present invention is not viewable to the properly aligned golfer, allowing the golfer to focus on the golf ball. If the head 10 is not properly aligned at address, the golfer will be able to see the indicia 15 and, therefore, know to adjust the club 1 to square it with the intended putting path. The golfer will also know in what manner to adjust the club 1 to square it. In the case of a right-handed golfer, seeing the indicia 15 to the right of the tube 20 indicates that the golfer should open the club 1, or rotate it clockwise. Seeing the indicia 15 to the left of the tube 20 indicates that the golfer should close the club 1, or rotate it counterclockwise.

Since the ball is positioned under the golfer's left eye or just off the golfer's left foot (for a right-handed golfer) in a preferred putting position, the indicia 15 may be positioned between the strike face 11 and a vertical plane passing through a heel and a toe of the head and including the intersection of the longitudinal axis of the tube 20 and the head 10. That is, the indicia 15 may be biased toward the face 11 so that it is not visible by the golfer's right eye under preferred putting conditions. The tube 20 may be coupled to the head 10 at an angle from vertical from about 2° to 45° as projected onto a vertical plane passing through a heel and a toe of the head, with about 10° to 30° being preferred. The shaft 40 may be coupled such that it is angled relative the head 10 within the same range. Preferably, the tube 20 and the shaft 40 are coupled such that their respective longitudinal axes are substantially parallel. This results in a clean look to the putter 1, and allows the benefits of using the alignment indicia 15 as discussed above. Coupling the tube 20 at an angle relative to the head 10 simultaneously allows the golfer the benefits of having both an offset club and an alignment aide.

Figure 3:
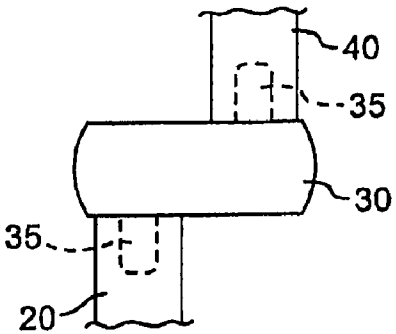
FIG. 3 shows an alternate embodiment of the coupling member of the golf club of FIG. 1.

The United States Golf Association (USGA) and the Royal and Ancient Golf Club of St. Andrews (R&A), the governing bodies of golf, have instituted rules defining "legal" golf clubs. It is important that clubs not violate these rules. Both of these governing bodies require that the shaft must be attached to the club head, either directly or through a single plain neck and/or socket, such that the length from the top of the neck and/or socket to the sole of the club must not exceed 5 inches, measured along the axis of, and following any bend in, the neck and/or socket. Thus, the travel distance from the bottom of the sole 12, along the tube 20 and coupling member 30, to the bottom of the shaft 40 where it is coupled to the coupling member second end 32 is 5 inches or less. To help achieve this requirement, the coupling member 30 may be provided with projections 35 over which the tube 20 and the shaft 40 are coupled. This embodiment of the coupling member 30 is shown in FIG. 3. The projections 35 are illustrated with dotted lines because they are not visible in the assembled golf club. This embodiment is distinguished from the embodiment shown in FIGS. 1 and 2, which includes projections into which the tube 20 and the shaft 40 are coupled. The tube 20 preferably has a length as measured from a junction with the head 10 to a junction with the coupling member 30 between about 1 inch and 4 inches.

Preferably, the strike face 11 has a loft angle (the angle of the face 11 relative a vertical plane passing through the leading edge of the club head 10) of 10° or less, and the sole 12 has a draft angle (the angle of the sole 12 relative a horizontal plane passing through the trailing edge of the club head 10) of 100 or less. Preferably, the loft angle and the draft angle are chosen such that the strike face 11 is substantially square when the club 1 is rested on the sole 12 at address. This beneficially facilitates closing the club head 1 during a golf swing. More preferably, the loft angle is from 2° to 6° and the draft angle is 5° or less.

The top line 13 has a length which may be described in thirds: a heel third, a middle third, and a toe third. The tube 20 preferably may be coupled to the club head 10 along the top line 13. While the tube 20 may be coupled to the top line 13 along any portion thereof, coupling in the heel or middle thirds of the top line 13 is preferred.

Figure 4:
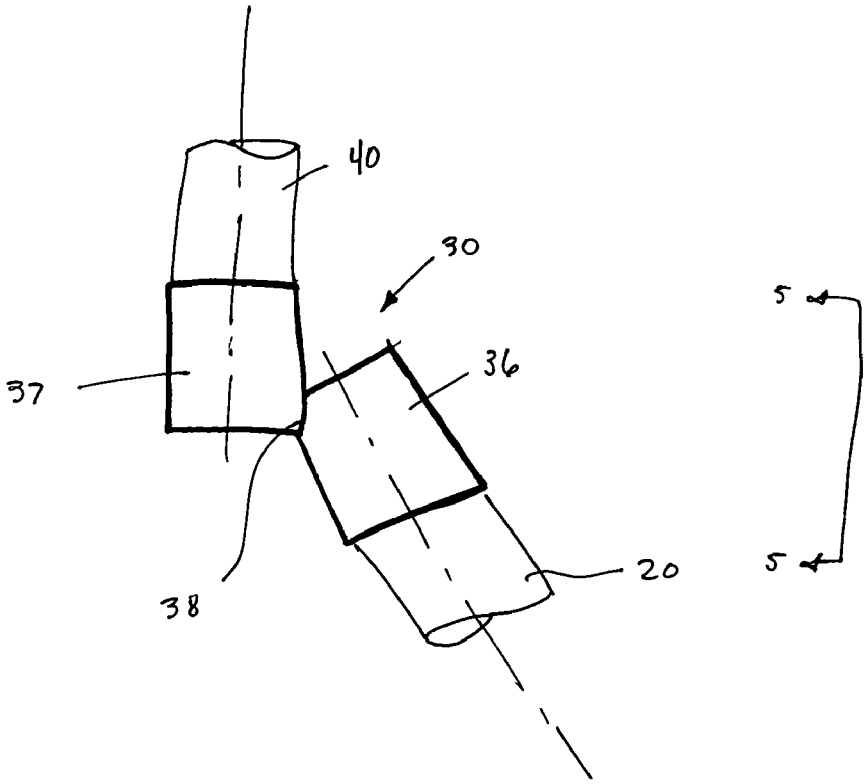
FIG. 4 shows a front view of a coupling member of the present invention.
Figure 5:
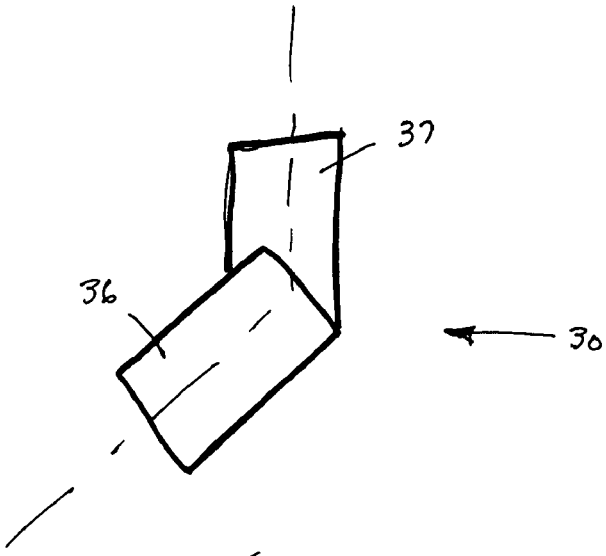
FIG. 5 shows a side view of the coupling member of FIG. 4.

FIG. 4 shows a front view of a coupling member 30 of the present invention, and FIG. 5 shows a side view, orthogonal to the view of FIG. 4, of the coupling member 30 of FIG. 4. In this illustrated embodiment, the coupling member 30 is malleable, allowing the relative positions of the lower portion 36 and the upper portion 37 to be varied. In this manner, the golf club designer or other person can alter the lie and/or loft angles to customize the golf club 1 to suit an individual player's swing. After such customization, the longitudinal axes of the shaft 40 and the tube 20 are not parallel. The adjustable coupling member 30 beneficially allows customization when using shafts that cannot be bent, such as graphite shafts. While the coupling member 30 is malleable to allow for adjustment, preferably it is not so malleable that it can be altered through normal use of the golf club 1.

In the illustrated embodiments of FIGS. 4 and 5, the coupling member 30 includes a lower tubular section 36 and an upper tubular section 37. The tube 20 is coupled to the coupling member lower section 36, and the shaft 40 is coupled to the upper section 37. It should be noted, however, that the adjustability benefits can also be used with other forms of the coupling member 30, such as the embodiment illustrated in FIG. 3. A connection 38 joins the coupling member portions 36, 38. The connection 38 may take a variety of forms, one preferred form being simply an area of weakened or thinned-out material. For example, one or more holes may be provided in the connection 38 to weaken it or material may be removed from the edges of the connection 38. Of course, the connection 38 is robust enough to withstand the stresses and strains imposed upon it through normal use of the golf club 1, at an acceptable factor of safety, without deformation. Preferred materials for the coupling member 30 including aluminum and stainless steels. The lower and upper portions 36, 37 can be formed together, or may be formed separately and then joined together in known fashion.

Longitudinal axes for the lower and upper coupling member sections 36, 37 are shown in FIGS. 4 and 5 for illustrative purposes. While a comparatively large degree of relative angulation between the lower and upper sections 36, 37 are shown, virtually any amount of angulation may be obtained. Furthermore, while the lower and upper sections 36, 37 are shown as being offset in the illustrated embodiment, they need not be. That is, the lower and upper sections 36, 37 may be oriented such that they share a common longitudinal axis prior to bending. This allows for customization without offset while using a graphite or other non-bendable shaft.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club, comprising:

a head;

a tube having a first end and a second end, said first end coupled to said head; and a coupling member having a first attachment portion and a second attachment portion, said tube second end being coupled to said first attachment portion, said first and second attachment portions being joined by a malleable connection such that relative positions of said first and second attachment portions are variable;

a shaft coupled to the coupling member having a longitudinal axis, wherein said coupling member provides an offset of said shaft from said head such that an extension of the longitudinal axis intersects the strike face of said head;

wherein the tube is formed of a material with a specific gravity less than the specific gravity of the head; and wherein said coupling member has a mass between 5 to 15 grams.

2. The golf club of claim 1, wherein:

said head has an alignment indicia thereon; and said tube completely blocks said indicia from a user's view at address when said head is aligned properly.

3. The golf club of claim 1, further comprising a shaft coupled to said coupling member second portion.

4. The golf club of claim 3, wherein said shaft has a first longitudinal axis and said tube has a second longitudinal axis substantially, said first and second longitudinal axes being not parallel.

5. The golf club of claim 3, wherein a travel distance from a junction between said shaft and said coupling member to said sole is 5 inches or less.

6. The golf club of claim 1, wherein said tube is coupled to said head at an angle from about 2° to 45° as projected onto a vertical plane passing through a heel and a toe of the head.

7. The golf club of claim 6, wherein said angle is from about 10° to 30°.

8. The golf club of claim 1, wherein said tube has a length as measured from a junction with said head to a junction with said coupling member between about 1 inch and 4 inches.

9. The golf club of claim 1, wherein:

said head has a top line with a length; and said tube is coupled to said top line in a middle third of said length.

10. The golf club of claim 1, wherein:

said head has a top line with a length; and said first shaft portion is coupled to said top line in a heel-end third of said length.

11. The golf club of claim 1, wherein said tube has a mass from 3 to 5 grams.

12. A golf club, comprising:

a head;

a tube coupled to said head, said tube having a first longitudinal axis and being formed of a lightweight material having a specific gravity less than a specific gravity of said head, wherein said tube has a first mass of 3 to 5 grams;

a coupling member coupled to said tube, wherein said coupling member has a second mass of 5 to 15 grams; and a shaft coupled to said coupling member having a second longitudinal axis substantially not parallel to said first longitudinal axis;

wherein said shaft is offset from said head; and wherein said coupling member provides said offset.

13. The golf club of claim 12, wherein said coupling member includes projections into which said tube and said shaft are coupled.

14. The golf club of claim 12, wherein said coupling member includes projections over which said tube and said shaft are coupled.

15. The golf club of claim 12, wherein said head includes an alignment indicia thereon.

16. The golf club of claim 15, wherein said indicia is positioned between a strike face of said club head and a vertical plane passing through a heel and a toe of said head and including an intersection of said first longitudinal axis and said head.

* * * * *